United States Patent [19]

McBurnett

[11] Patent Number: 4,828,462

[45] Date of Patent: May 9, 1989

[54] PRESSURE DETECTING SYSTEM FOR A HYDRAULIC DEVICE

[75] Inventor: James R. McBurnett, Corinth, Miss.

[73] Assignee: Dana Corporation, Toledo, Ohio

[21] Appl. No.: 131,062

[22] Filed: Dec. 10, 1987

[51] Int. Cl.[4] ..... F04B 49/02; F04B 49/08

[52] U.S. Cl. ..... 417/291; 417/310; 417/307; 418/200

[58] Field of Search ..... 417/307, 310, 311, 291; 418/200, 74

[56] References Cited

U.S. PATENT DOCUMENTS

| | | | |
|---|---|---|---|
| 2,636,440 | 4/1953 | Funk | 417/291 |
| 2,639,694 | 5/1953 | Johnson | 418/206 |
| 2,777,396 | 1/1957 | Adams | 418/74 |
| 3,182,596 | 5/1965 | Prijatel | 418/310 |
| 3,280,756 | 10/1966 | Gordon | 418/132 |
| 3,733,813 | 5/1973 | Gordon . | |
| 3,746,979 | 7/1973 | Spencer | 418/206 |
| 3,824,041 | 7/1974 | Rystrom | 418/180 |
| 3,884,604 | 5/1975 | Smith . | |
| 3,902,566 | 9/1975 | Bird . | |
| 4,182,125 | 1/1980 | Spivey, Jr. . | |
| 4,495,767 | 1/1985 | Akiyama et al. . | |
| 4,548,231 | 10/1985 | Schwede . | |

FOREIGN PATENT DOCUMENTS

| | | | |
|---|---|---|---|
| 1395404 | 5/1975 | United Kingdom | 418/74 |

*Primary Examiner*—William L. Freeh

*Attorney, Agent, or Firm*—MacMillan, Sobanski & Todd

[57] ABSTRACT

A system for detecting when the pressure on a bi-directional hydraulic device, such as a motor or a pump, exceeds a predetermined pressure. The device is of the type having two meshing gears mounted to rotate in a housing. Fluid inlet and outlet ports are located in the housing on opposite sides of the meshing gear teeth. A pilot port is located in the housing to detect the fluid pressure between one gear and the housing at a location isolated from the inlet and outlet ports. The sensed pressure is a function of the maximum pressure at the inlet and outlet ports.

6 Claims, 2 Drawing Sheets

PRESSURE DETECTING SYSTEM FOR A HYDRAULIC DEVICE

TECHNICAL FIELD

This invention relates to hydraulic devices such as motors and pumps and more particularly to a maximum fluid pressure detecting system for a bi-directional hydraulic gear motor or gear pump.

BACKGROUND ART

In a hydraulic system including a hydraulic gear motor, it is desirable to provide for fluid pressure relief in the event that the load on the motor becomes excessive. Without pressure relief, an excessive load or a stalled motor may cause damage to system components. In one arrangement, the fluid inlet and outlet ports to the motor are connected by a cross-over relief valve. This is a normally closed valve connected between the ports. The valve also has a pilot port which is connected to the inlet port to the motor. When a predetermined pressure is exceeded at the pilot port, the valve is opened to allow hydraulic fluid to bypass the motor.

For a bi-directional motor, either port may be the inlet port, depending upon the direction in which the motor is to be driven. This type of motor requires two cross-over relief valves mounted in parallel between the two motor ports. Each valve is responsive to the pressure on a different port. In another arrangement, a single cross-over valve is connected through four check valves to the two motor ports. The check valves allow the highest pressure fluid at the two motor ports to flow to the inlet of the cross-over valve and allow the output from the cross-over valve to flow to the motor port having the lowest pressure. Both of these arrangements require more valves than are necessary to protect the motor.

A hydraulic gear pump may have substantially the same design as a hydraulic gear motor. The only difference is that rotary motion is converted to fluid pressure in the pump, while fluid pressure is converted to rotary motion in the motor. Cross-over relief valves have been used to limit the fluid pressure of a pump in the same manner in which such valves limit fluid pressure in a motor. For a bi-directional hydraulic pump, two cross-over relief valves are required, as with the bi-directional motor.

Many hydraulic motor driven systems have a normally set hydraulic brake. The brake is of the pressure release type and is released only after sufficient hydraulic pressure is applied to the motor. Such a system is used, for example, in hydraulically operated elevators and for hydraulically operated excavation equipment. Since the motors are bi-directional, the brake must be released in response to the highest pressure at either of two fluid ports on the motor. Typically, the two ports are connected through individual check valves to the brake release valve. Or, the two ports may be connected to two inputs to a single shuttle valve which in turn operates the brake release valve. In either arrangement, the valves are more expensive than is necessary.

DISCLOSURE OF INVENTION

According the invention, a single valve is used to sense the highest pressure on either of two ports in a hydraulic gear device such as a gear motor or a gear pump. The device is of the type having two gears mounted to rotate in bores within a housing. The gears each have teeth spaced around their periphery. A portion of the teeth on each gear contact walls of the housing bores and the teeth located between the gears mesh. First and second ports are formed on opposite sides of the meshed gear teeth. Thus, the gears isolate the two ports from each other. Depending upon the direction in which the gears rotate and depending upon whether the device is operated as a motor or a pump, one of the ports will be an inlet port and the other port will be an outlet port.

A third port is formed in the housing to communicate with one of the bores at a location between a gear and the bore wall which is spaced between the first and second ports. At this location, the fluid will have substantially the same pressure as the highest fluid pressure at the first and second ports. Accordingly, a single valve connected to the third port will be responsive to the highest fluid pressure. The single valve may be, for example, a normally closed cross-over relief valve connected between the first and second ports and having a pilot input connected to the third port. When the fluid at the third port exceeds a predetermined pressure, the valve is opened to interconnect the first and second ports. Or, the valve connected to the third port may be a brake release valve or a valve or switch used for any other desired purpose where information is required on the maximum pressure on either of the two ports.

Accordingly, it is an object of the invention to provide an improved means for sensing the highest pressure on the two ports to a bi-directional hydraulic device.

Other objects and advantages to the invention will be apparent from the following detailed description and the accompanying drawings.

BEST MODE FOR CARRYING OUT THE INVENTION

Figure 1:
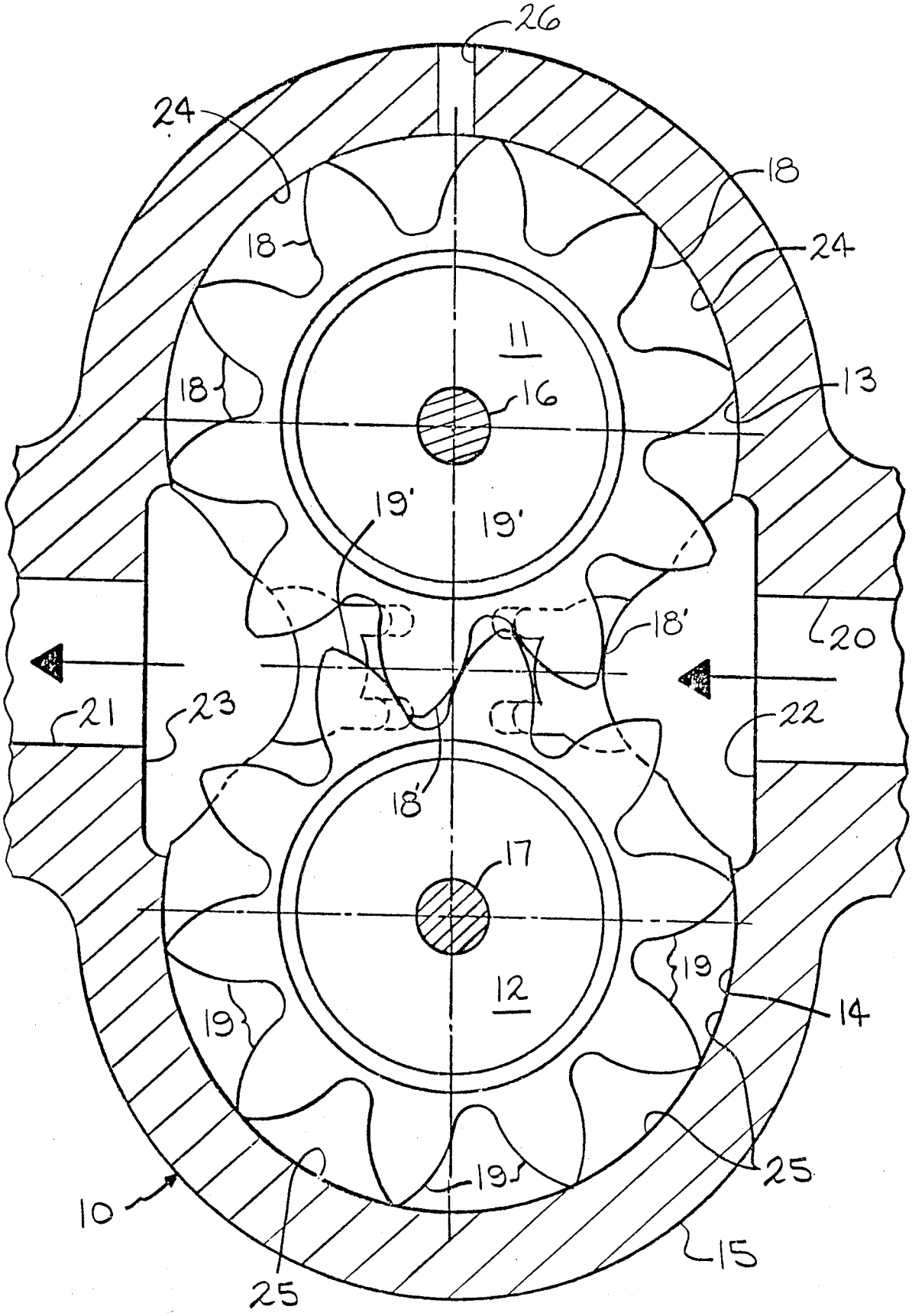
FIG. 1 is a fragmentary cross sectional view through a hydraulic gear device which may be used as a motor or a pump.
Figure 2:
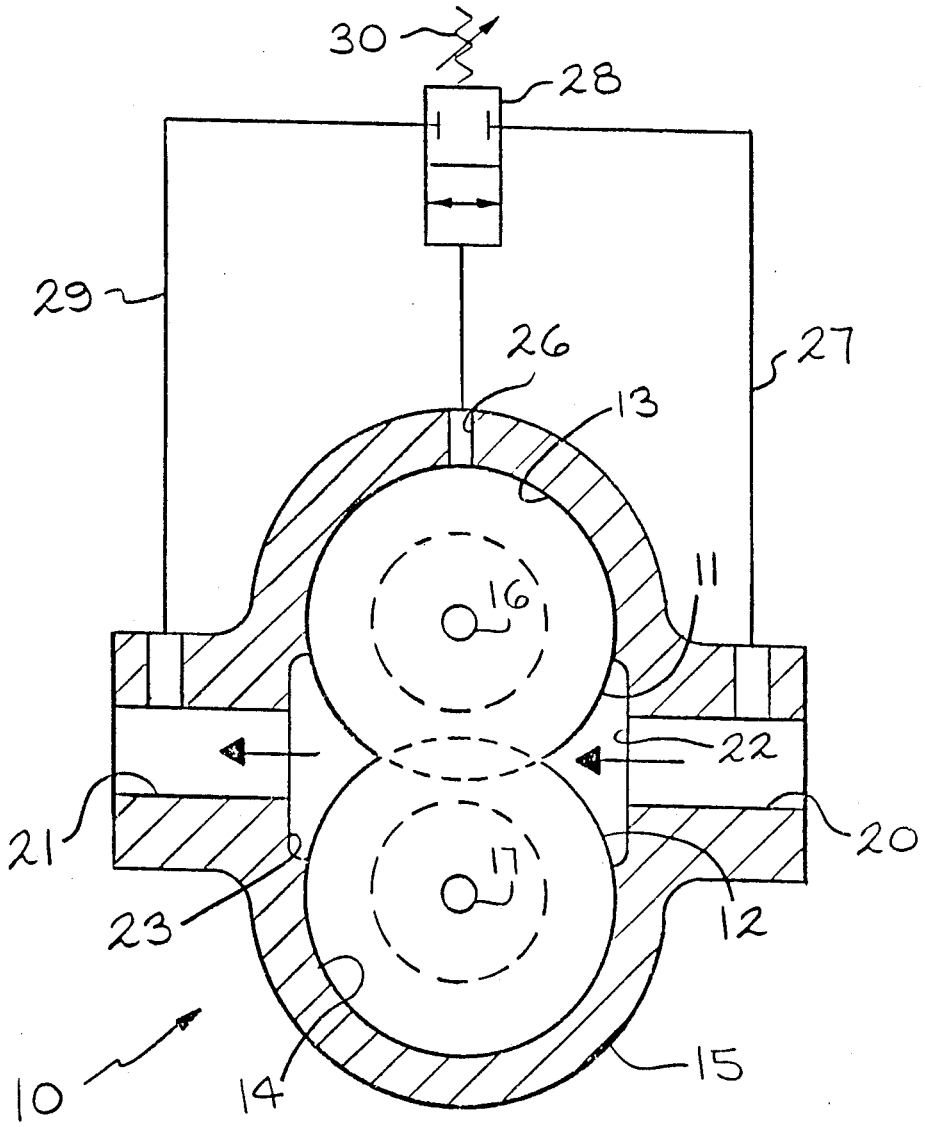
FIG. 2 is a diagrammatic view of the device of FIG. 1 connected with a cross-over relief valve.

Turning to FIGS. 1 and 2 of the drawings, a hydraulic motor 10 is illustrated of the type having two gears 11 and 12 mounted to rotate in bores 13 and 14, respectively, in a housing 15. The gear 11 is attached to a shaft 16 and the gear 12 is attached to a shaft 17. At least one of the shafts 16 or 17 is an output shaft for the motor 10. The gear 11 has a plurality of teeth 18 spaced around its periphery. Several of the teeth 18 contact and slide against the wall of the bore 13. Similarly, the gear 12 has a plurality of teeth 19 spaced around its periphery and several of the teeth 19 contact and slide against the wall of the bore 14. Teeth 18' and 19' between the gears 11 and 12, respectively, mesh.

Two ports 20 and 21 are formed in the housing 15. The port 20 communicates with a chamber 22 and the port 21 communicates with a chamber 23. The chambers 22 and 23 are located on opposite sides of the meshed gear teeth 18' and 19'. The meshed gear teeth 18' and 19' and the contact between the gear teeth 18 and 19 and the walls of the bores 13 and 14 isolate the chambers 22 and 23 from each other.

In operation, if the shaft 17 is to be driven in a clockwise direction, the port 20 will be the inlet port and the port 21 will be the outlet port. Of course, the inlet and outlet ports are reversed when the direction of rotation for the shaft 17 is reversed. The higher pressure fluid entering the port 20 will flow into chambers 24 formed between the gear teeth 18 and the wall of the bore 13 and into chambers 25 formed between the gear teeth 19 and the wall of the bore 14. The fluid pressure causes the gears to rotate in opposite directions unitl the fluid is discharged into the chamber 23 as the gear teeth 18 and 19 begin to mesh.

It has been found that as the gears 11 and 12 are rotated, the fluid pressure in each of the closed chambers 24 and 25 will remain at substantially the same pressure as the fluid in the inlet chamber 22 until each chamber 24 and 25 communicates with the outlet chamber 23. Accordingly, by locating a third port 26 in the housing to communicate with either the chambers 24 or the chambers 25 at a location between and isolated from the chambers 22 and 23, the fluid pressure at the inlet chamber 22 can be detected. If the fluid pressure in the chamber 23 exceeds the fluid pressure in the chamber 22, the port 23 becomes the inlet port and the direction of the motor will be reversed. However, the fluid pressure at the third port 26 will now be substantially the same as the fluid pressure in the chamber 23. Regardless of the direction of rotation of the gears 11 and 12, the fluid pressure at the single third port 26 will always be substantially the same as the highest pressure in the chamber 22 or the chamber 23.

As shown in FIG. 2, the port 20 may be connected through a line 27 to one side of a normally closed cross-over relief valve 28 and the port 21 may be connected through a line 29 to the other side of the valve 28. The third port 26 on the motor 10 supplies fluid to a pilot port on the valve 28. A spring 30 biases the valve 28 to a normally closed position. The spring 30 is adjusted to allow the valve 28 to open when a predetermined fluid pressure is detected at the motor port 26. When the valve 28 opens, fluid flows from the high pressure inlet port 20 or 21 to the lower pressure outlet port 21 or 20 and is shunted around the motor 10. When the load on the motor decreases sufficiently, the reduced pressure in the inlet chamber will be transmitted through the port 26 to the pilot input to the valve 28 and the valve 28 will again close. Thus, the valve 28 is in effect a switch which is actuated whenever the fluid pressure at the third port 26 on the motor 10 exceeds a predetermined pressure. If desired, an electric pressure sensing switch (not shown) may be connected to the port 26 for generating a signal indicative of the maximum fluid pressure at the ports 20 and 21.

For certain applications for the motor 10, a normally actuated brake is connected to a load driven by the motor 10. For example, in a hydraulically driven power shovel, the shovel will move only when the motor is driven. It would be dangerous to allow the shovel to fall if hydraulic pressure is removed from the motor. The brake is released only when there is sufficient hydraulic pressure on the motor to prevent the shovel from falling. By connecting a brake release valve to the third port 26 on the housing 15, a simplified arrangement is provided for releasing the brake, regardless of the direction in which the motor 10 is driven.

It will be appreciated that although FIGS. 1 and 2 have been described in conjunction with a motor 10, the same device may be used as a pump merely by driving one of the gear shafts 16 or 17 from an external power source. If the shaft 17 is driven in a clockwise direction, the port 20 will be a low pressure inlet port and the port 21 will be a high pressure outlet. The third port 26 on the housing 15 will still have a pressure of substantially the highest pressure on the ports 20 and 21. The pressure at the port 26 may be used for controlling a cross-over relief valve or for any other desired parameter. Various modifications and changes may be made in the above described embodiments of the invention without departing from the spirit and the scope of the following claims.

I claim:

1. A bi-directional hydraulic device comprising:

a housing forming first and second intersecting bores, a first gear located to rotate in said first bore, said first gear having a plurality of teeth spaced around its periphery with some of such teeth contacting the wall of said first bore, a second gear located to rotate in said second bore, said second gear having a plurality of teeth spaced around its periphery with some of such teeth contacting the wall of said second bore, some of said first gear teeth meshing with some of said second gear teeth, said housing defining first and second fluid port means on opposite sides of said meshed gear teeth, said gears isolating said second port means from said first port means, said first and second port means supplying fluid to and carrying fluid from said device, and means for sensing pressure of fluid between one of said gears and said housing at a location wherein the fliud is isolated from said first and second port means by said housing and the teeth on such one gear, such sensed pressure being a function of the higher fluid pressure at said first and second port means, said sensing means including a third port formed through said housing communicating with the location at which the fluid pressure is sensed and switch means actuated in response to the fluid pressure in said third port exceeding a predetermined pressure.

2. A bi-directional hydraulic device, as set forth in claim 1, wherein said switch means includes a normally closed valve connected between said first and second port means, and wherein said switch means opens said valve in response to the fluid pressure in said third port exceeding such predetermined pressure.

3. A bi-directional hydraulic device, as set forth in claim 2, wherein said valve permits bi-directional fluid communication between said first and second fluid port means when opened.

4. An improvement to a bi-directional hydraulic motor comprising:

first and second port means for supplying fluid to and carrying fluid from said motor, a third port formed in said motor at a location at which the fluid pressure is a function of the maximum fluid pressure at said first and second port means, and means connected to said third port to sense the maximum pressure at said first and second port means, said sensing means including switch means actuated in response to the fluid pressure in said third port.

5. An improved bi-directional hydraulic motor, as set forth in claim 4, wherein said switch means includes a normally closed fluid valve connected between said first and second port means, and means responsive to the fluid pressure in said third port exceeding a predetermined pressure for opening said fluid valve.

6. A bi-directional hydraulic device comprising:

a housing forming first and second intersecting bores, a first gear located to rotate in said first bore, said first gear having a plurality of teeth spaced around its periphery with some of such teeth contacting the wall of said first bore, a second gear located to rotate in said second bore, said second gear having a plurality of teeth spaced around its periphery with some of such teeth contacting the wall of said second bore, some of said first gear teeth meshing with some of said second gear teeth, first and second fluid port means formed in said housing on opposite sides of said meshed gear teeth, said gears isolating said second port means from said first port means, said first and second port means supplying fluid to and carrying fluid from said device, and third fluid port means formed in said housing at a location wherein the fluid is isolated from said first and second port means by said housing and the teeth on such one gear, the pressure of the fluid at said third fluid port means being a function of the higher fluid pressure at said first and second port means; and a valve for selectively permitting bi-directional fluid communication between said first and second fluid port means, said valve being responsive to the fluid pressure at said third fluid port means for permitting such communication only when said fluid pressure exceeds a predetermined maximum level.

* * * * *